US006516790B1

(12) United States Patent
Darlington

(10) Patent No.: US 6,516,790 B1
(45) Date of Patent: Feb. 11, 2003

(54) SINGLE-CAM COMPOUND ARCHERY BOW

(76) Inventor: Rex F. Darlington, 6828 Maple Acres Dr., Whittemore, MI (US) 48770

( * ) Notice: Subject to any disclaimer, the term of this patent is extended or adjusted under 35 U.S.C. 154(b) by 0 days.

(21) Appl. No.: 09/676,794

(22) Filed: Sep. 29, 2000

(51) Int. Cl.[7] ..... F41B 5/10
(52) U.S. Cl. ..... 124/25.6; 124/900
(58) Field of Search ..... 124/23.1, 25.6, 124/86, 900

(56) References Cited

U.S. PATENT DOCUMENTS 992,901 A * 5/1911 Pipkin
1,376,742 A * 5/1921 Burnett
4,519,374 A 5/1985 Miller (List continued on next page.)

FOREIGN PATENT DOCUMENTS

CA 2183305 2/1997

OTHER PUBLICATIONS

Mulloney, "One Step Beyond the Compound?" Archery World, Sep. 1976.
"Graham Take–Down Dynabo," Archery World, Jun./Jul. 1980.

(List continued on next page.)

*Primary Examiner*—John A. Ricci
(74) *Attorney, Agent, or Firm*—Reising, Ethington, Barnes, Kisselle, Learman & McCulloch, P.C.

(57) ABSTRACT

A single-cam compound archery bow that includes a bow handle having projecting limbs, a control wheel rotatably mounted on an end of one of the limbs, and a power cam rotatably mounted on the end of the other limb. The power cam includes a cam base and a draw length adjustment module that is adjustably positioned on or adjustably replaceable on the cam base. A power cable segment is anchored at one end to the one limb and at a second end to the power cam at a position to wrap into and unwrap from a power cable groove on the draw length adjustment module. The sidewalls of the power cable groove are eliminated adjacent to the axis of the power cam to eliminate the undesirable feel of the power cable rubbing against the groove sidewalls at the limit of bow draw. A bowstring cable segment is anchored to the control wheel and to the power cam at positions to wrap into and unwrap from first and second bowstring let-out grooves on the control wheel and the power cam respectively. The bowstring cable segment may be anchored to the draw length adjustment module for adjusting position of this anchor simultaneously with adjustment of bow draw length, and thereby maintaining optimum stored energy in the bow without requiring adjustment at the control wheel. The power cam and control wheel are secured to the limbs by axles that are affixed to the cam and wheel, and rotatably extend through bearings in the limbs. Indicia are provided on the cam base for incremental registry with the periphery of the draw length adjustment module to facilitate adjustment.

50 Claims, 9 Drawing Sheets

U.S. PATENT DOCUMENTS

| | | | | | |
|---|---|---|---|---|---|
| 4,774,927 | A | | 10/1988 | Larson | |
| 4,838,236 | A | | 6/1989 | Kudlacek | |
| 4,926,832 | A | | 5/1990 | Darlington | |
| 4,926,833 | A | | 5/1990 | Darlington | |
| 4,967,721 | A | | 11/1990 | Larson | |
| 4,976,250 | A | | 12/1990 | Jeffrey | |
| 4,986,250 | A | | 1/1991 | Darlington | |
| 5,092,309 | A | | 3/1992 | Beaton | |
| 5,301,651 | A | | 4/1994 | LaBorde et al. | |
| 5,368,006 | A | | 11/1994 | McPherson | 124/25.6 |
| 5,433,792 | A | | 7/1995 | Darlington | 124/25.6 |
| 5,505,185 | A | | 4/1996 | Miller | 124/25.6 |
| 5,649,522 | A | | 7/1997 | Troncoso | 124/25.6 |
| 5,678,529 | A | | 10/1997 | Larson | 124/25.6 |
| 5,782,229 | A | | 7/1998 | Evans et al. | 124/25.6 |
| 5,791,322 | A | | 8/1998 | McPherson | 124/25.6 |
| 5,934,265 | A | | 8/1999 | Darlington | 124/25.6 |
| 5,975,067 | A | | 11/1999 | Strother | 124/25.6 |
| 6,076,512 | A | * | 6/2000 | Thielen et al. | 124/25.6 |
| 6,082,347 | A | | 7/2000 | Darlington | 124/25.6 |
| 6,112,732 | A | | 9/2000 | Larson | 124/25.6 |
| 6,237,582 | B1 | * | 5/2001 | McPherson | 124/25.6 |
| 6,247,466 | B1 | * | 6/2001 | McPherson | 124/25.6 |
| 6,250,293 | B1 | * | 6/2001 | Andrews | 124/25.6 |
| 6,321,736 | B1 | * | 11/2001 | McPherson | 124/25.6 |

OTHER PUBLICATIONS

Patent application of Larry D. Miller for "Archery Bow Assembly," date and serial number unknown.

Alpine Archery Bow Manual, 1989.

"Instruction Manual—York Thunderbolt DynaBo," York Archery (date unknown).

"M–10 Dynabo Draw Chart," Martin Archery, Inc. (date unknown).

M–10 Cheetah DynaBo Owner's Manual, Martin Archery (date unknown).

* cited by examiner

SINGLE-CAM COMPOUND ARCHERY BOW

The present invention is directed to compound archery bows, and more particularly to a so-called single-cam compound archery bow having a power let-off cam mounted on the end of only one of the bow limbs.

BACKGROUND OF THE INVENTION

Compound archery bows typically are of the so-called dual-cam design, originated in U.S. Pat. No. 3,486,495. Bows of this type typically comprise a bow handle having limbs mounted on and extending from opposed ends of the handle. Power let-off cams are rotatably mounted on the free ends of the bow limbs, and are interconnected by one or more cable sections including a draw string section. As the bow draw string is drawn away from the handle, draw force initially increases as the limbs are drawn together and the cams rotate to a power let-off point, and thereafter the leverage increases and the draw force decreases as the cams rotate further but with little additional limb flexure. This so-called compound action allows full bow draw to be maintained at lesser force without fatigue to the archer. A problem inherent in dual-cam bows of this type lies in the fact that the cams must be closely matched and synchronized with each other in order to insure straight-line (or substantially straight-line) travel of the nock point on the bowstring, and the limbs must be closely balanced and evenly stressed as the string is drawn. Damage to or mismatch of the cams, mismatch or incorrect adjustment of the limbs, or stretching of the cable sections can cause loss of synchronization between the cams and uneven stressing of the limbs, resulting in less than optimum performance of the bow and erratic arrow flight.

In order to overcome the aforementioned deficiencies of dual-cam bows, it has heretofore been proposed to provide a compound bow that has a single power let-off cam disposed at the end of one bow limb, and a control pulley or wheel disposed at the end of the opposing limb over which the bowstring is trained. U.S. Pat. No. 5,505,185 discloses such a single-cam compound bow. A control cable cooperates with a power let-off cam and a control groove in the control wheel or a second let-out groove on the power cam to maintain the desired relationship or timing between bowstring let-out grooves in the control wheel and power cam.

In this way, identical or substantially identical incremental bowstring cable travel to and from the bowstring let-out grooves is obtained, thereby yielding straight-line nock travel as the bowstring cable is drawn and released. A power cable extends from the power cam to the opposing bow limb for flexing the blow limbs uniformly as the bowstring is drawn, and for cooperating with the power cam to obtain the power let-off action that is characteristic of compound bows.

Although the single-cam compound bow disclosed in the noted patent addresses and overcomes many problems theretofore extant in the art, further improvements remain desirable. In particular, the noted patent does not disclose any means or technique for adjusting draw length of the bow. That is, the bow disclosed in the noted patent obtains straight-line nock travel for a given bow draw length for which the power cam and the control wheel or the second let-out groove of the power cam are designed. In order to change or adjust bowstring draw length, the power cam and/or the control wheel must be changed to accommodate the new desired draw length while maintaining synchronous timing between the cam and wheel. In a commercial single-cam compound bow of a different design, accommodation is made for changing the bowstring cable anchor point at the power let-off cam, and thereby changing the bowstring draw length. However, since the cams and wheels are optimized for only a single draw length, changing the bowstring anchor point inherently changes the path of nock travel as the bow is drawn and released, and consequently affects shootability of the bow.

U.S. Pat. No. 5,934,265 discloses a single-cam compound archery bow that includes a bow handle from which bow limbs project, a control wheel rotatably mounted on one end of one limb and a power cam rotatably mounted at an opposing end of the other limb. A power cable segment is anchored at one end to the one limb and at a second end to the power cam at a position to wrap into and unwrap from a power cable groove on the power cam. A bowstring cable segment is anchored to the control wheel and to the power cam at positions to wrap into and unwrap from first and second bowstring let-out grooves on the control wheel and the power cam respectively. The bowstring cable segment has a nock point disposed between the spaced limb ends. A control cable segment is anchored at one end to the control wheel at a position to wrap into and unwrap from a control groove on the control wheel, and is anchored at an opposing end to the power cam. As the bowstring cable segment is drawn away from the handle, the bowstring cable segment unwraps equally from the control wheel and power cam, wraps the power cable segment into the power cable groove on the power cam so as to draw the bow limb ends together to a power let-off point at the power cable groove, and wraps the control cable segment into the control groove on the control wheel. Length of the power cable groove on the power cam, and position of the power let-off point on the power cam, are adjustable while maintaining a fixed separation between the power let-off point and the control cable anchor on the power cam, so that the nock point travels in a straight line as the bowstring cable section is drawn and released independent of adjusted length of the power cable groove and position of the power let-off point. U.S. Pat. No. 6,082,347 discloses a single-cam compound archery bow in which, in the preferred embodiments, provision is made at both the power cam and the control wheel for adjusting bowstring cable draw length. Furthermore, timing indicia are provided on both the power cam and the control wheel for selective registry with the control cable segment on the control wheel and the power cable segment on the power cam to fine-tune adjustment of nock point travel.

BRIEF DESCRIPTION OF THE DRAWING

The invention, together with objects, features and advantages thereof, will be best understood from the following description, the appended claims and the accompanying drawings in which:

DETAILED DESCRIPTION OF THE PREFERRED EMBODIMENTS

The disclosures of above-noted U.S. Pat. Nos. 5,934,265 and 6,082,347 are incorporated herein by reference for purposes of background.

Figure 1:
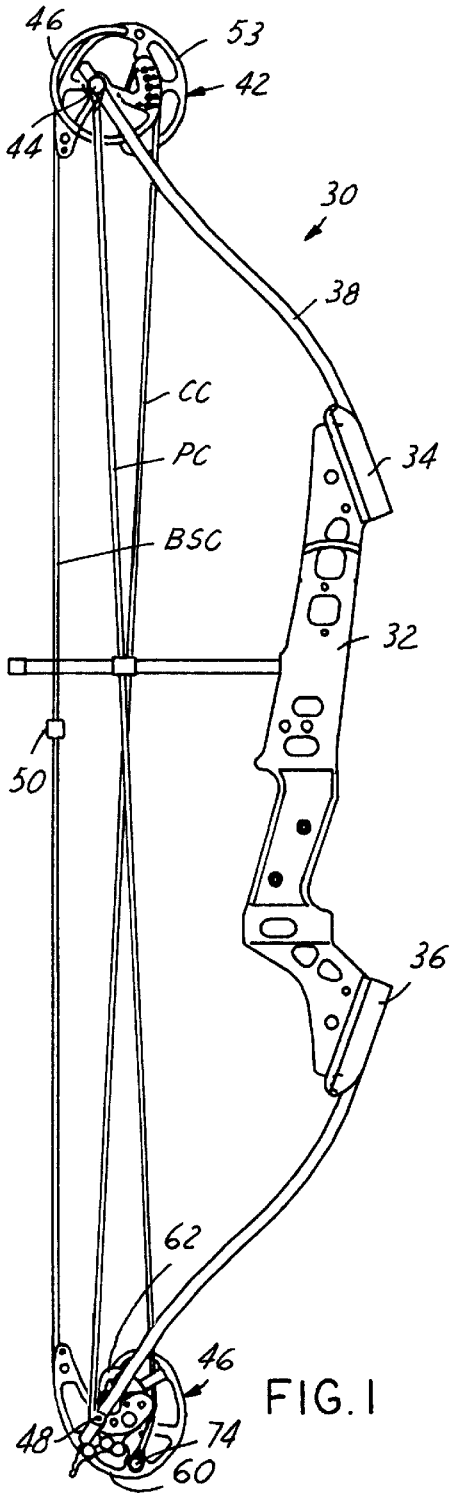
FIG. 1 is a side elevational view of a single-cam compound archery bow in accordance with one presently preferred embodiment of the invention.
Figure 2:
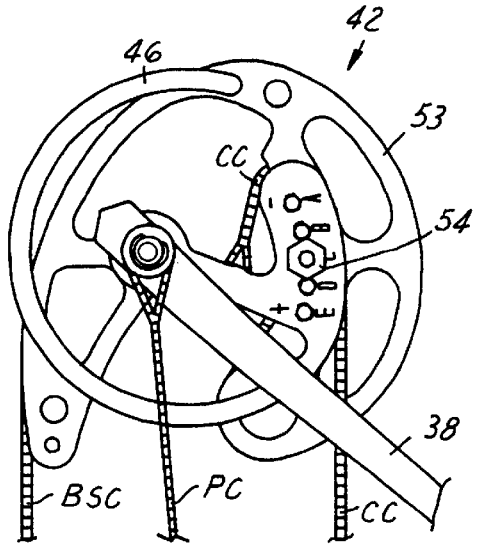
FIGS. 2 and 3 are fragmentary elevational views of opposite sides of the control wheel mounted on the upper limb in the bow of FIG. 1.
Figure 3:
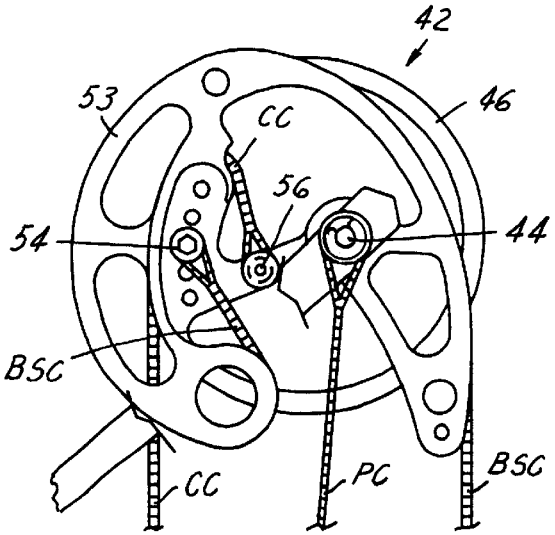
Figure 6:
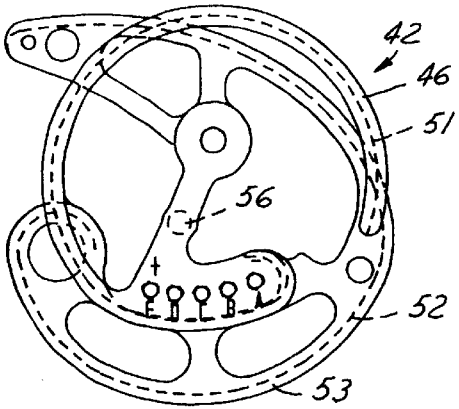
FIGS. 4, 5 and 6 are respective front, side and back elevational views of the control wheel illustrated in FIGS. 1–3.
Figure 5:
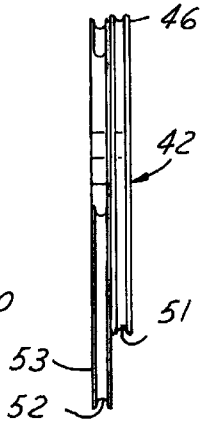
Figure 4:
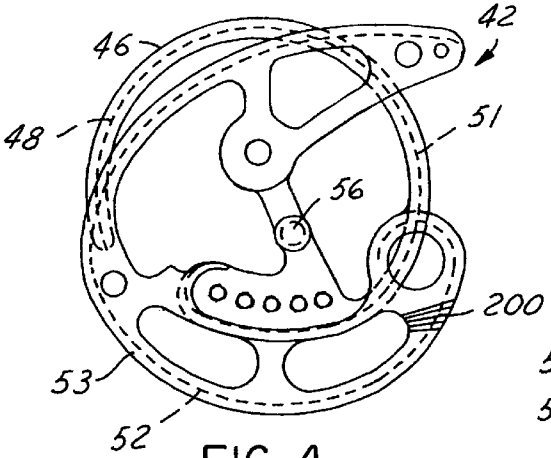
Figure 8:
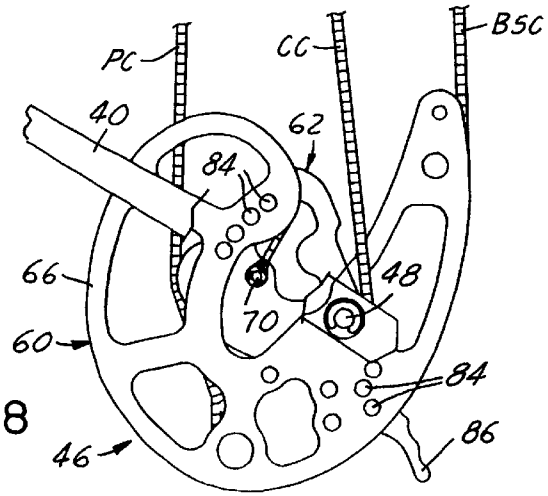
FIGS. 7 and 8 are fragmentary elevational views of opposite sides of the power cam on the lower limb in the bow of FIG. 1.

FIG. 1 illustrates a single-cam compound archery bow 30 in accordance with one presently preferred embodiment of the invention as comprising a handle 32 of cast magnesium or other rigid unitary construction having spaced ends 34, 36 with flat limb-mounting surfaces at each end. A pair of flexible resilient limbs 38, 40 of fiber-reinforced resin or other suitable resilient construction are mounted on handle ends 34, 36 respectively, and project away from handle 32. A control wheel 42 is rotatably mounted on an axle 44 that extends laterally across the free end of bow limb 38, such that control wheel 42 is rotatably mounted within an open notch or bracket at the free end of limb 38. Likewise, a power cam 46 is rotatably mounted on an axle 48 that extends laterally across the free end of limb 40, such that power cam 46 is rotatably mounted within a notch or bracket at the free end of limb 40. The positions of control wheel 42 and power cam 46 may, of course, be reversed. A power cable PC has a split end that is anchored to limb 38 at axle 44, preferably although not necessarily on both sides of control wheel 42. Power cable PC extends across bow 30 to power cam 46, at which power cable PC is anchored. A control cable CC is anchored at one end to control wheel 42 and at an opposing end to power cam 46. Likewise, a bowstring cable BSC is anchored at opposing ends to control wheel 42 and power cam 46. A nock 50 is carried by bowstring cable BSC between control wheel 42 and power cam 46.

Referring in detail to FIGS. 2–6, control wheel 42 comprises a one-piece frame that mounts a bearing through which axle 44 extends. A part-circular track 46 surrounds axle 44, within which a radially outwardly facing peripheral control groove 51 is formed. That is, control or timing groove 51 is of generally circular geometry off-center with respect to axle 44 around which control wheel 42 rotates. A non-circular second track 53 extends around control wheel 42 laterally offset from track 46, within which a radially outwardly facing bowstring let-out groove 52 is formed. Bowstring let-out groove 52 is thus of non-circular geometry in this embodiment of the invention. Both grooves 51, 52 are eccentric to the axis of the axle in this embodiment. Control wheel 42 is preferably of one-piece monolithic construction. At the rest position of the bow (FIGS. 1–3), bowstring cable BSC is trained entirely around bowstring let-out groove 52 to an anchor 54 carried by control wheel 42. Control cable CC is trained in the opposite direction around control groove 51, and thence to an anchor 56 on control wheel 42. In the embodiment of the invention illustrated in FIGS. 1–6, anchor 54 is adjustably positionable on control wheel 42 for fine-tuning draw length of the bow. This feature is described in greater detail in above-referenced U.S. Pat. No. 6,082,347.

Figure 11:
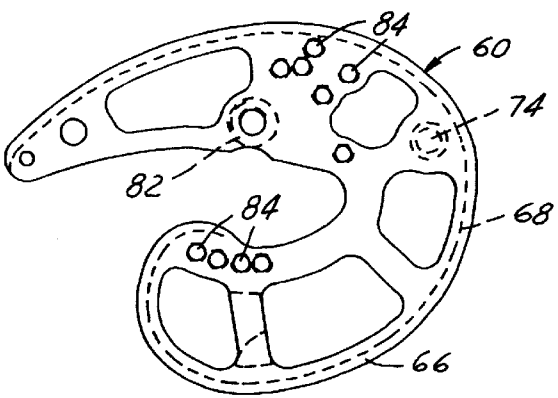
FIGS. 9, 10 and 11 are respective front, side and back elevational views of the cam base in the power cam of FIGS. 7 and 8.
Figure 10:
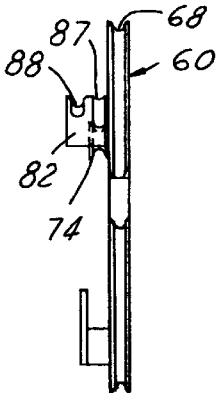
Figure 9:
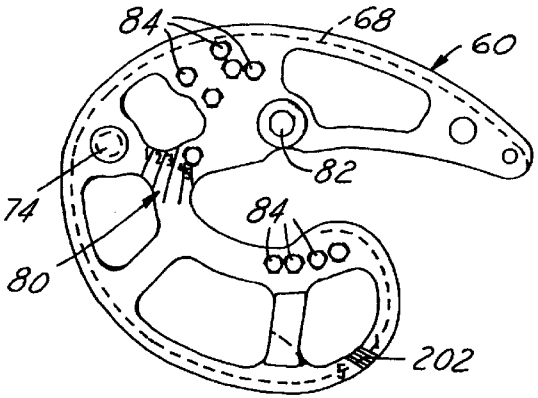
Figure 14:
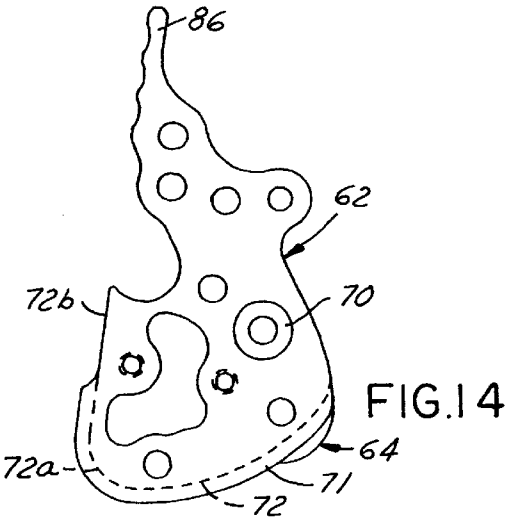
FIGS. 12, 13 and 14 are front, side and back elevational views of the draw length adjustment module in the power cam of FIGS. 7 and 8.
Figure 13:
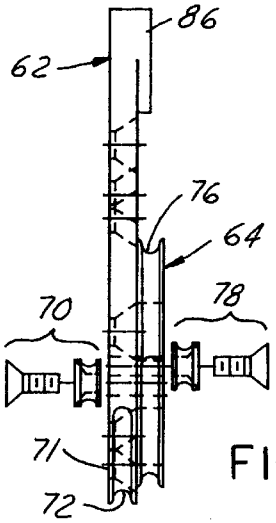
Figure 12:
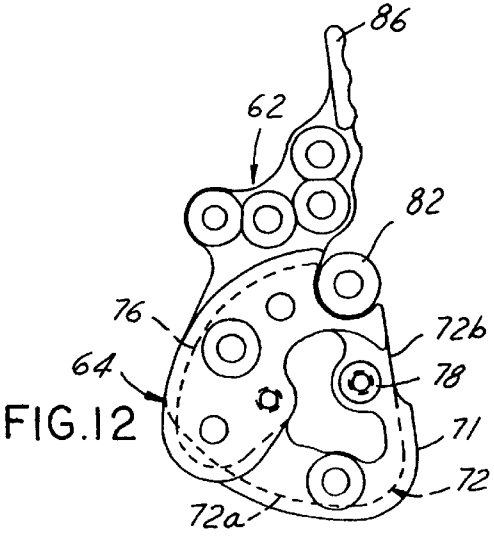

Power cam 46 is illustrated in detail in FIGS. 7–14. Power cam 46 includes a cam base 60 on which a draw length adjustment module 62 and a control arm 64 are mounted. A track 66 extends around the periphery of cam base 60 and forms a radially outwardly extending bowstring let-out groove 68 (FIGS. 9–11). Bowstring cable BSC anchors at 70 (FIGS. 8, 13 and 14) adjacent to and aligned with groove 68. Draw length adjustment module 62 is rotatably mounted on cam base 60, and has a radially outwardly facing track 71 that forms the power cable take-up groove 72. A power cable anchor 74 (FIGS. 7 and 9) is provided on cam base 60 adjacent to and in alignment with groove 72 on module 62 when the module is mounted on the cam base. In accordance with one feature of the present invention, bowstring anchor 70 is formed not on cam base 60, but is assembled to the underside of module 62 at a position to be aligned in assembly with bowstring take-up groove 68 in cam base 60. By anchoring the bowstring cable to the module rather than to the cam base, major draw length changes can be made solely at the power cam while maintaining optimum stored energy in the cam throughout the entire draw length adjustment range. When draw length adjustments are made by rotating the module, the functional length of the bowstring cable changes. This results in a greater usable range of draw lengths for a given module and better stored energy characteristics. When the draw length is increased, the bowstring cable becomes effectively longer because of the direction in which the module is rotated and the fact that the bowstring is anchored to the module. Likewise, when draw length is decreased, the bowstring becomes effectively shorter. For example, draw length module 62 may provide for four inches of draw length adjustment at power cam 46 without requiring any corresponding adjustment at the control wheel, and while maintaining optimum stored energy in the bow. Draw length may be fine-tuned at the control wheel by selectively positioning bowstring cable anchor 54, which may provide incremental adjustments of ⅛ inch, for example. However, in accordance with this feature of the present invention, draw length adjustment is not needed at control wheel 42 to maintain optimum stored energy in the bow when drawn.

Figure 7:
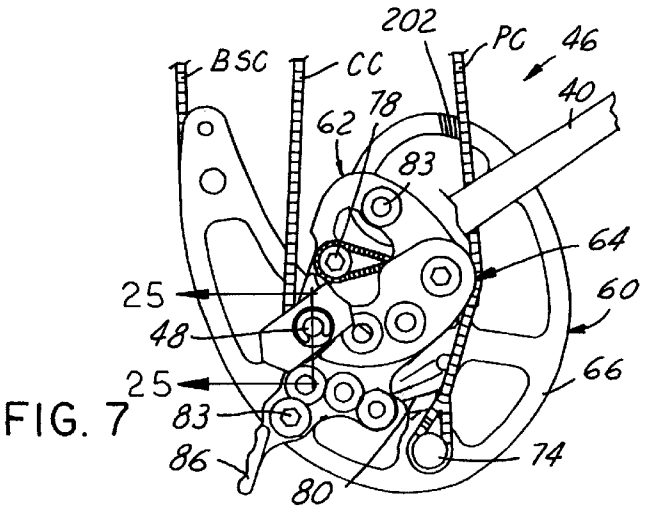
Figure 26:
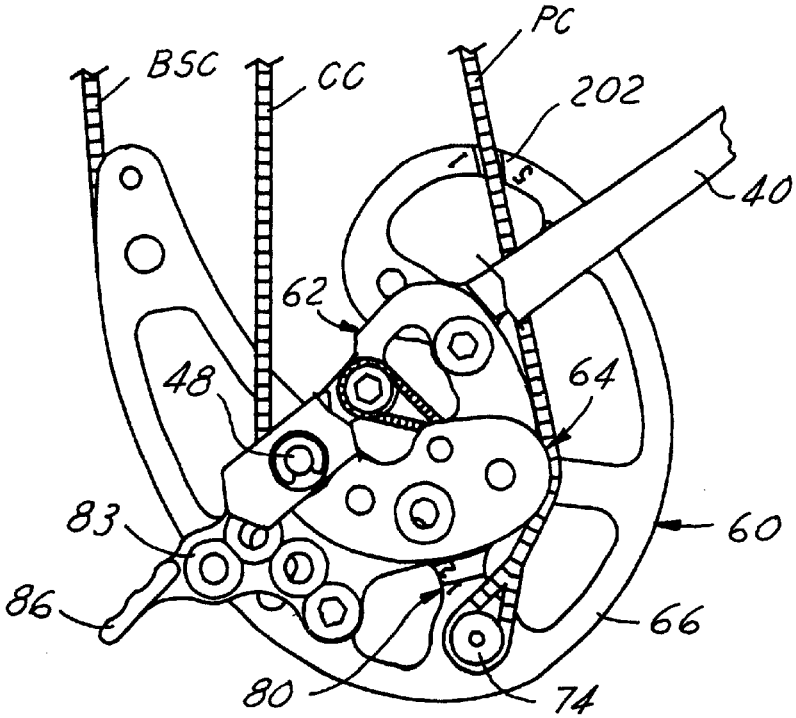
FIG. 26 is a fragmentary elevational view similar to that of FIG. 7 but showing the draw length adjustment module and power cable at differing adjustment positions.

In accordance with another aspect of the invention illustrated in the power cam embodiment of FIGS. 7–14, control arm 64 and module 62 are of integrally formed unitary construction—i.e., one-piece monolithic construction. Control arm 64 has a peripheral groove 76 into which control cable CC wraps and then extends to an anchor 78 (FIGS. 7, 12 and 13) also affixed to module 62. Thus, both control cable anchor 78 and control cable groove 76 of control arm 64 are automatically adjustably positioned simultaneously with adjustable positioning of module 62. Provision of control arm 64 integral with module 62 not only reduces the number of component parts in the bow assembly and rigidly secures the control arm to the module against loosening during use, but also provides automatic adjustment of the control cable length simultaneously with adjustment of draw length as described above. FIGS. 7 and 9 illustrate an additional aspect of the present invention, in accordance with which indicia 80 are provided on cam base 60 for incremental register with the periphery of draw length module 62 as position of draw length module 62 is incrementally adjusted around axle boss 82 and the axis of axle 48. These indicia are preferably coordinated with incremental draw length adjustment in accordance with an instruction sheet or the like provided with the bow. For example, five arcuate lines are illustrated in FIG. 9, respectively numbered "1" to "5." Depending upon the module being employed, these lines and numbers would be coordinated on an instruction sheet with incremental adjustment positioned. For example, line "1" may be associated with a draw length of 21 inches, line "2" with a draw length of 22 inches, line "3" with a draw length of 23 inches, line "4" with a draw length of 24 inches and line "5" with a draw length of 25 inches. In accordance with this aspect of the invention, a plurality of adjustable draw length modules may be provided with the bow, each of which has a peripheral portion for incremental registry with indicia 80, but for which the incremental position numbering would correspond to differing draw lengths. Thus, by referring to the instruction sheet associated with the bow, the user may rapidly select the desired module and adjust the cables correctly to tune the bow if necessary. With the module positioned at the desired location on the cam base, the operator refers to timing marks 200 on control wheel 42 (FIG. 4) and 202 on power cam 46 (FIG. 7), which preferably are incrementally numbered in association with indicia 80 on the cam base, to make sure that the cables are adjusted correctly and properly tuned. See U.S. Pat. No. 6,082,347 with respect to tuning marks 200, 202. Compare FIG. 7 in which module 62 is at the "5" position on base 60 and cable PC is aligned with the "5" tuning mark 202, with the position illustrated in FIG. 26 in which module 62 is at the "2" position on base 60 and cable PC is at the "2" position at tuning marks 202. The module is secured in the desired position by screws 83 (FIG. 7) received in threaded openings 84 on cam base 60 (FIGS. 9 and 11). As noted above, additional fine-tuning adjustment may be implemented by positioning anchor 54 (FIG. 2) on control wheel 42.

Yet another aspect of the present invention is best illustrated in FIGS. 7–8 and 12–14. Axle boss 82 is positioned on cam base 60 to surround axle 48. Power cable groove 72 in draw length adjustment module 62 has a first portion 72*a* spaced from boss 82, and thus spaced from the axis of rotation of the power cam, and a second flat portion 72*b* adjacent to and tangential to the periphery of boss 82. At the rest position of the power cam illustrated in FIGS. 1, 7 and 8, power cable PC is tangential to module 62 in groove portion 72*a*, extending through groove portion 72*a* from anchor 74 to the end of limb 38 (FIG. 1). As bowstring cable BSC is drawn by a bow user, power cam 60 rotates clockwise in FIG. 7, and counterclockwise in FIG. 8, so as to wrap power cable PC into groove portion 72*a* to and beyond the power let-off point of groove 72. At the fully drawn position, power cable PC is tangential to groove portion 72*b* across boss 82 to draw stop 86. Groove sidewalls confine groove portion 72*a* to prevent lateral motion of the cable out of groove 72. However, in groove portion 72*b*, such groove sidewalls are eliminated. It has been found that, at the extreme of bowstring draw, the power cable is at an angle to the plane of groove 72 and rubs against the sidewalls of groove 72, and this rubbing can be felt by the bow user. Eliminating the groove sidewalls in flat groove portion 72*b* eliminates this rubbing. However, the power cable extends entirely through groove portion 72*a*, and thus does not slip off of module 62. Axle boss 82 has a groove segment 87 (FIG. 10) for receiving power cable PC at the fully drawn power cable position against stop 86, and a groove segment 88 for feeding control cable CC to groove 76 in control arm 64.

Figure 15:
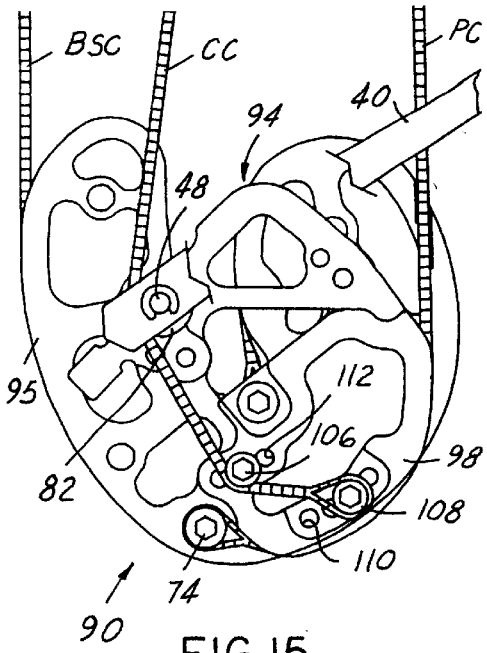
FIGS. 15 and 16 are fragmentary elevational views similar to those of FIGS. 7 and 8 but illustrating a power cam in accordance with a modified embodiment of the invention.
Figure 16:
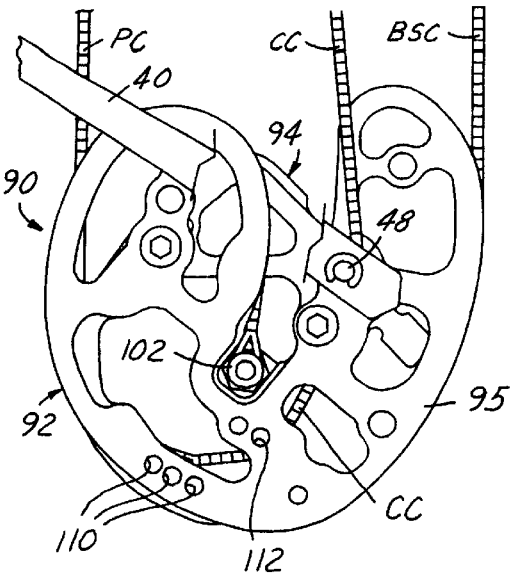
Figure 17:
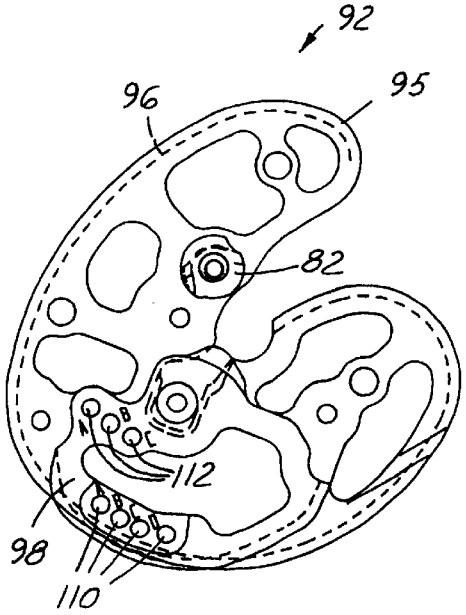
FIGS. 17 and 18 are respective front and side elevational views of the cam base in the power cam of FIGS. 15 and 16.
Figure 18:
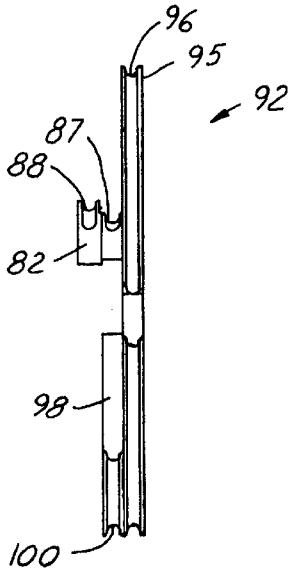
Figure 19:
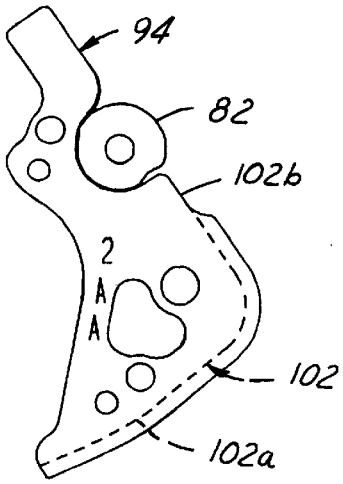
FIGS. 19 and 20 are front and back elevational views of the draw length adjustment module in the power cam of FIGS. 15 and 16.
Figure 20:
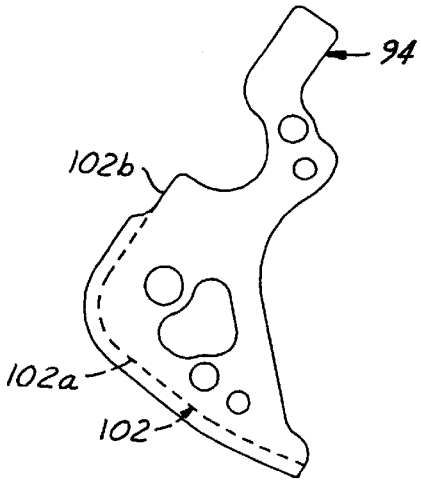
Figure 21A:
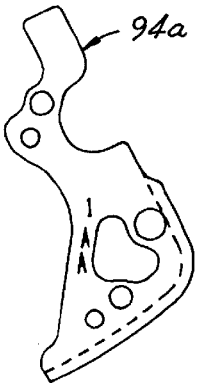
FIG. 21 illustrates additional draw length adjustment modules for the power cam of FIGS. 15 and 16.
Figure 21B:
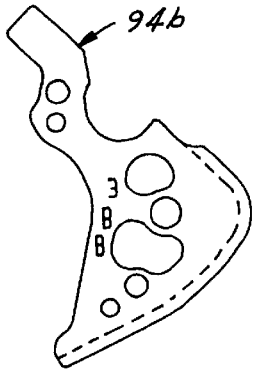
Figure 21C:
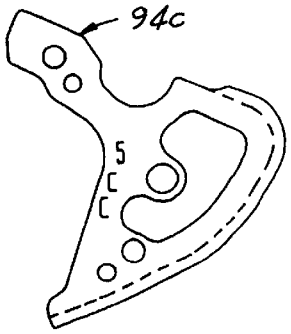
Figure 21D:
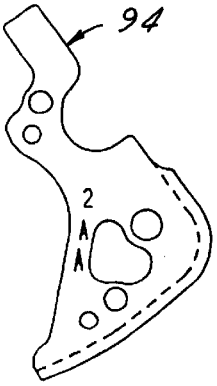
Figure 21E:
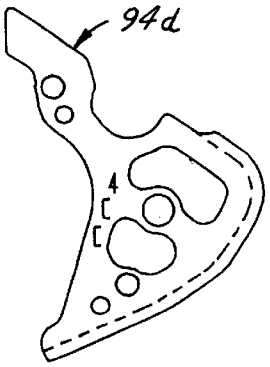
Figure 21F:
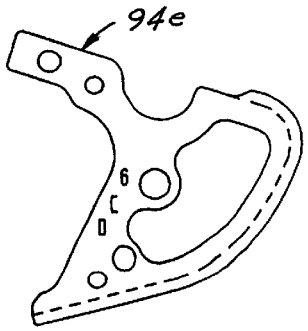

FIGS. 15 and 16 illustrate a modified power cam 90 in accordance with the present invention, FIGS. 17 and 18 illustrate the cam base 92 in power cam 90, FIGS. 19 and 20 illustrate the draw length module 94 in power cam 90, and FIG. 21 illustrates a number of additional draw length modules 94*a*–94*e* that may be used in place of draw length module 94 for differing draw length adjustments. (In all of the modifications of FIGS. 19–24, reference numerals identical to those used in FIGS. 1–18 indicate identical or corresponding components.) Power cam 90 includes draw length adjustment module 94 mounted on power cam base 92. Power cam base 92 has a track 95 with a peripheral bowstring let-out groove 96 and a power cable guide segment 98 with a power cable groove extension 100—i.e., an extension of power cable peripheral groove 102 (FIGS. 19 and 20) of draw length adjustment module 94. Boss 82 is mounted on cam base 92 for encircling axle 48, as in the prior embodiment. In this embodiment, the bowstring anchor 102 is mounted on cam base 92 adjacent to and aligned with bowstring cable groove 96, rather than being mounted on the draw length module as in the embodiment of FIGS. 1–14. Control cable CC (which may be an integral continuation of bowstring cable BSC) extends around arcuate groove 88 on boss 82, around a post 106 on cam base guide segment 98, and then to an anchor 108 also positioned on cam base guide segment 98. Anchor 108 is adjustably positionable on cam base segment 98 by means of the anchor being selectively secured within one of a plurality of adjacent internally threaded openings 110 (FIG. 17). Likewise, post 106 is selectively positionable on cam base segment 98 by means of a plurality of laterally adjacent internally threaded openings 112. Each opening 110, 112 is designated by a corresponding identifier, such as a letter "A," "B," "C," etc. Thus, the user may adjust the draw length of the bow by using the desired module and selectively positioning post 106 and anchor 108 in correspondingly identified openings 112, 110. This adjustment is preferably undertaken in conjunction with operator instructions that coordinate post positions and modules with incremental draw lengths. In this embodiment, module 94 is replaceably mounted on cam base 92 (see modules 94*a* to 94*e* in FIG. 21), but not adjustably mounted on the cam base. Draw length adjustment is thus accomplished by a replaceable module 94. The correct openings to be used for posts 106, 108 are noted on an operator instruction sheet and/or the replacement modules. For example, the modules may be identified by number and letter such as "1AA" (94*a* in FIG. 21) indicating that openings A and A are to be used for posts 106, 108, while another module may be marked "6CD" (94*e* in FIG. 21) indicating that hole C is to be used for post 106 and hole D is to be used for post 108. Anchor 74 for power cable PC is positioned on cam base 92 adjacent to and aligned with the power cable groove 100 in cam base segment 98. It should be noted that, in this embodiment of the invention, bow draw length is adjusted by changing draw length modules. Selective positioning of posts 106, 108 adjust nock point travel. That is, anchor 108 and post 106 are positioned on power cam 90 in accordance with the user instructions to obtain or approximate straight-line travel of nock point 50 (FIG. 1).

Thus, in the embodiment of FIGS. 15–21, as bowstring cable BSC is withdrawn and power cam 90 rotates clockwise in FIG. 15 (counterclockwise in FIG. 16), bowstring cable BSC is withdrawn from groove 96 on cam base 92, power cable PC is wrapped into groove segments 100, 102 on cam base segment 98 and draw length module 94, and bowstring cable BSC is unwrapped from around post 106. Eventually, bowstring cable BSC extends in a straight line from anchor 108 to the wheel at the opposing end of the bow, being unwrapped from post 106 and boss 82. It will be noted that power cable groove 102 on draw length module 94 includes a portion 102*a* remote from boss 82 having groove sidewalls, and a portion 102*b* adjacent to boss 82 without groove sidewalls, as in the prior embodiment.

Figure 24:
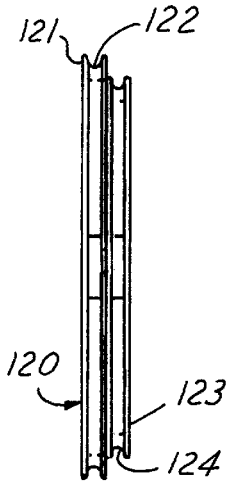
FIG. 24 is an end elevational view of the control wheel illustrated in FIGS. 22 and 23.
Figure 22:
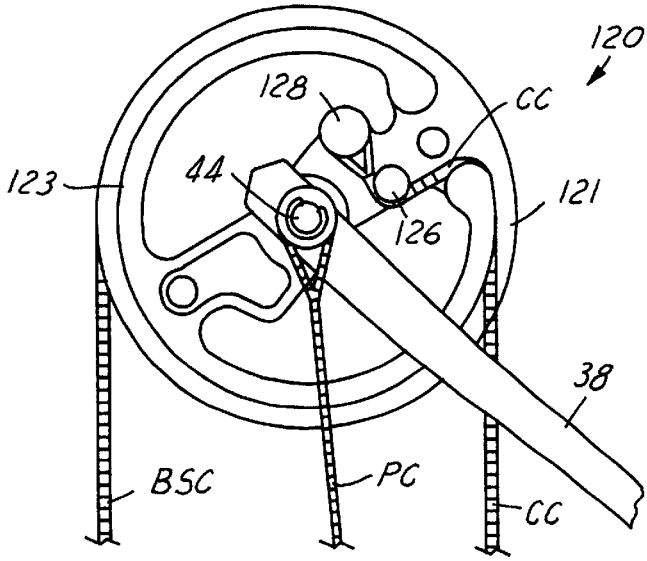
FIGS. 22 and 23 are side elevational views similar to those of FIGS. 2 and 3 but illustrating a modified control wheel in accordance with the present invention.
Figure 23:
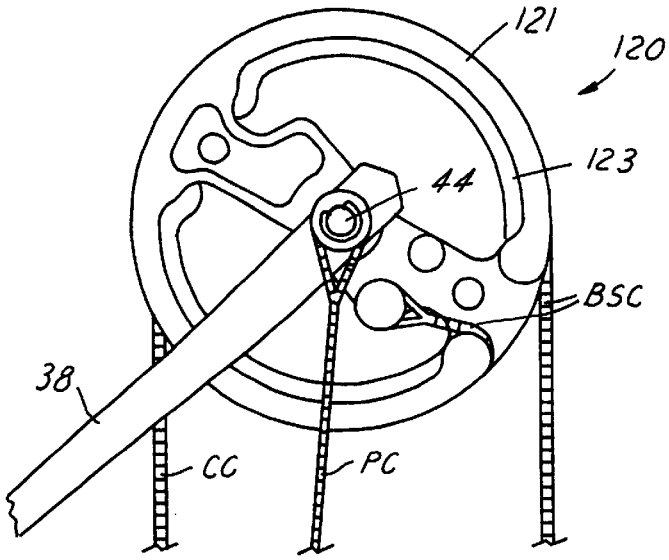

FIGS. 22–24 illustrate a modified control wheel 120, which maybe used in place of control wheel 42 in FIGS. 1–6. Control wheel 120 is characterized by providing a bowstring track 121 with a groove 122 and a control cable track 123 with a groove 124. Grooves 122, 124 are of circular geometry, are concentric with each other and with the axis of axle 44, and have differing radii with respect to the axis of axle 44. Under certain circumstances with certain power cam constructions, it has been found that control wheel 120 provides improved control of limb travel. Control cable CC extends through groove 124 around a post 126 to an anchor 128. The smaller diameter groove 124 allows a smaller shape to be used for the second let-out groove on the power cam, particularly as compared to the use of a concentric control (idler) wheel instead of a two-groove control wheel. When employed in conjunction with a post-feed power cam of the type illustrated in FIGS. 15 and 16, use of a smaller concentric groove 124 reduces the required let-out from the post. The position of anchor 128 maybe adjustable. Bowstring cable BSC extends around peripheral groove 122 to an anchor 130. The position of anchor 130 may be adjustable.

Figure 25:
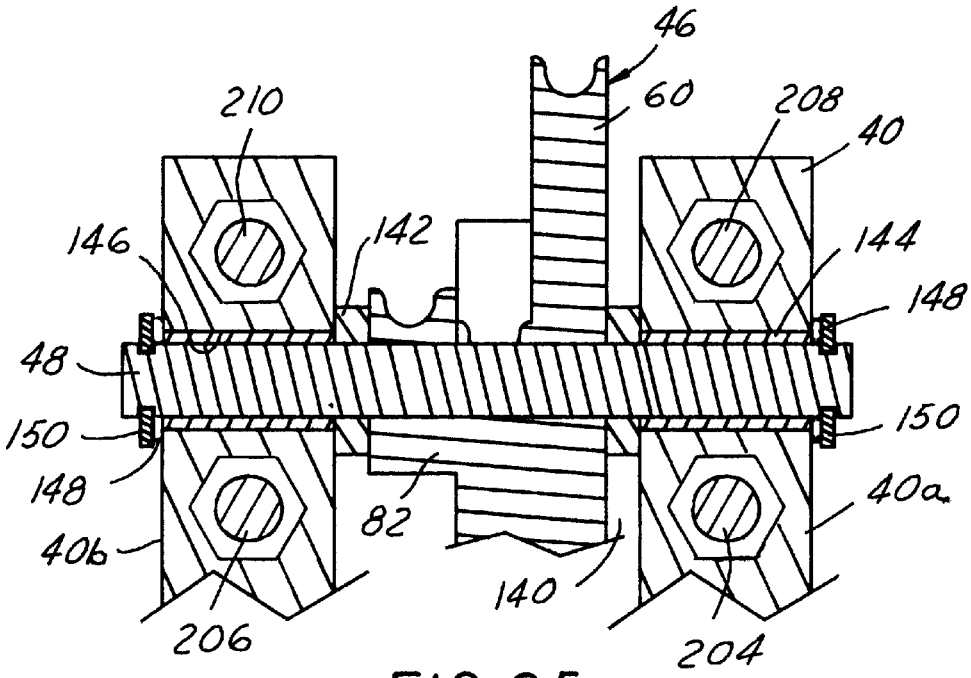
FIG. 25 is a fragmentary sectional view taken substantially along the line 25—25 in FIG. 7.

FIG. 25 illustrates another aspect of the present invention, in which power cam 46 (FIG. 1, or power cam 90 in FIGS. 15–16, or control wheel 42 in FIG. 1 or control wheel 120 in FIGS. 22–24) is rotatably mounted to limb 40 by an axle 48 that is secured to cam base 60 and rotatably carried in bearings in limb 40. That is, axle 48 is secured to cam base 60. This may be accomplished, for example, by providing an axle opening in cam base 60 that is sufficiently small so that axle 48 is press fitted into the cam base as the axle and cam are assembled to limb 40. Alternatively, axle 48 may be secured to cam base 60 by adhesive applied to the cam base prior to assembly to limb 40. Cam 46 and cam base 60 are spaced from the opposing edges of the fork at the end of limb 40 by a pair of spacers 140, 142. A pair of sleeve bearings 144, 146 are secured in axial alignment on opposite sides of the fork in limb 40. Axle 48 is rotatably secured at each end to limb 40 by a pair of washers 148 and snap rings 150. It has been found that securement of axle 48 to cam base 60 provides a more stable assembly and reduces tilt of cam 46 during operation of the bow. It is also to be noted that principles of the present invention may be employed in conjunction with a control wheel that has a single groove around its periphery concentric with the axis of rotation. In such an application, in which the control wheel is sometimes referred to as an idler or idler wheel, the control cable and the bowstring cable form a continuous cable that simply wraps around the groove in the control wheel. The control cable and the bowstring cable form a continuous wrap around the periphery of the control or idler wheel, and neither cable segment is anchored to the control wheel.

FIG. 25 illustrates another aspect of the present invention, which may be used separately from or in combination with other aspects of the invention as described above. Each flexible resilient bow limb 38, 40 (FIG. 1) has a pulley disposed in a notch at the free end of the limb, as described above. Pulley 46 is illustrated in FIG. 25 mounted at the free end of limb 40. The notch in which the pulley is mounted is defined by a pair of laterally spaced limb forks 40*a*, 40*b*. A pair of clamp screws 204, 206 extend through limb forks 40*a*, 40*b* immediately inboard of axle 48—i.e., adjacent to axle 48 and between the axle and bow handle 32 (FIG. 1). In situations where the bow limbs are placed under extreme stress, clamp screws 204, 206 help prevent splitting or delamination of the bow limb. A second pair of clamp screws 208, 210 may be disposed outboard of axle 48 under extreme conditions. Use of clamp screws 204–210 to prevent splitting of the bow limbs in particularly effective in conjunction with compound crossbows.

Figure 27:
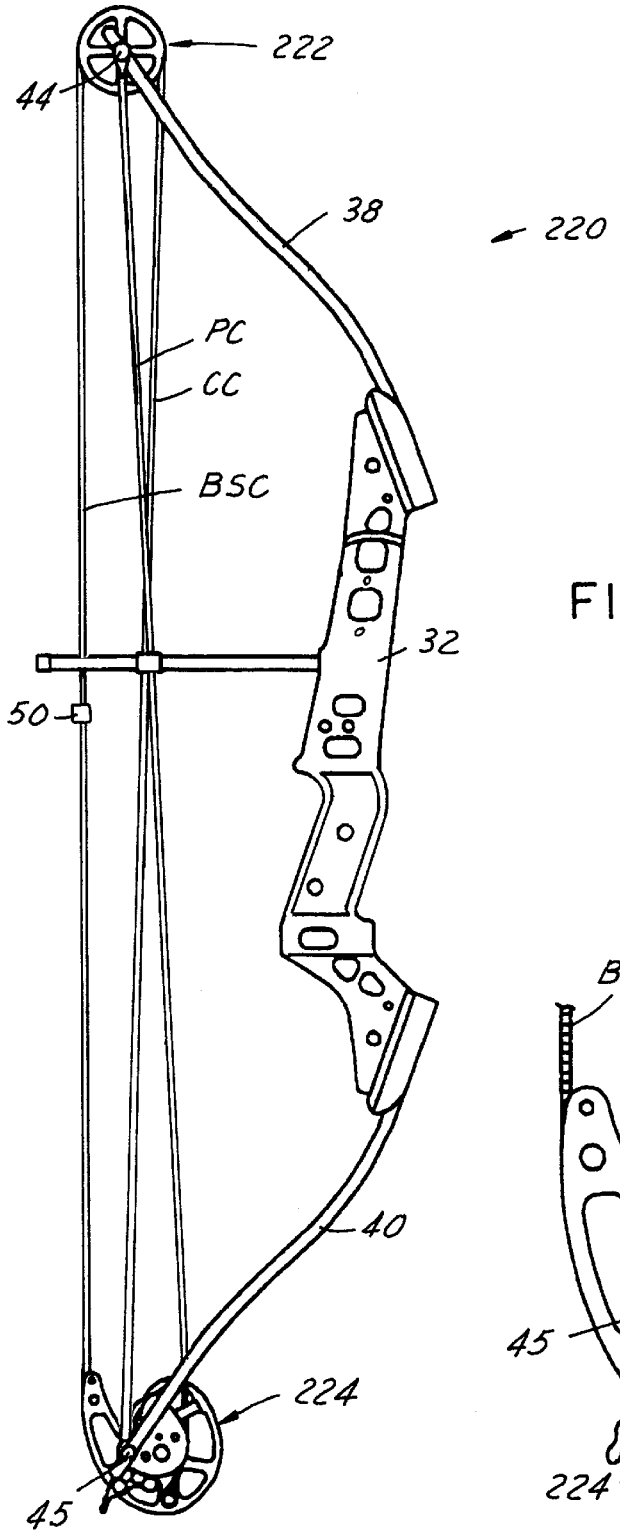
FIG. 27 is a side elevational view of a bow similar to that of FIG. 1 but possessing a modified control wheel and power cam.
Figure 28:
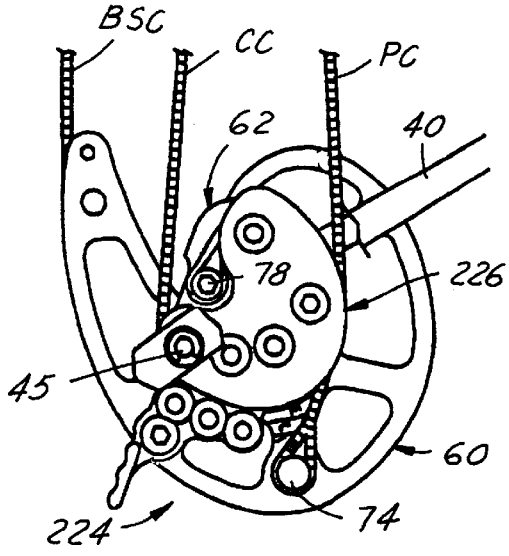
FIG. 28 is a fragmentary elevational view similar to that of FIG. 7 but showing the modified power cam of FIG. 27.
Figure 29:
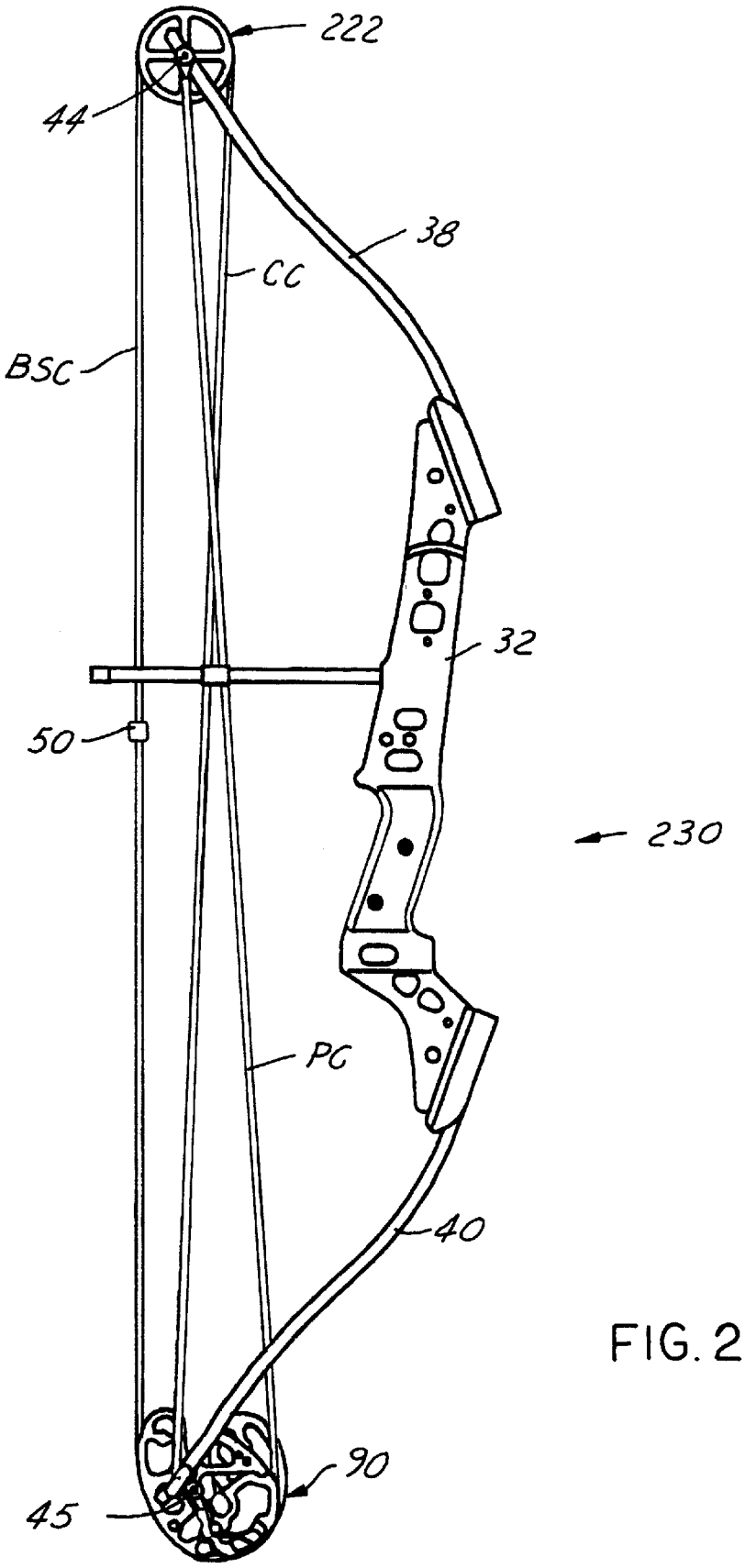
FIG. 29 is a side elevational view of a bow similar to that of FIG. 27 but having the power cam of FIGS. 15–21.

FIG. 27 illustrates a single cam bow 220 having a single-groove control wheel or idler 222 and a power cam 224. Control wheel 222 has a single peripheral groove that is concentric with axle 44. Control cable CC and bowstring cable BSC form a continuous cable segment that extends around the periphery of control wheel 222. Power cam 224 (FIGS. 27 and 28) is essentially the same as power cam 46 (FIGS. 1 and 7–14), but has a control arm 226 with enlarged peripheral groove to make up for the absence of a contoured control groove on control wheel 222. FIG. 29 illustrates a single-cam bow 230 having single-groove concentric control wheel or idler 222 in combination with a power cam 90, as shown in detail in FIGS. 15–21.

There has thus been provided a compound archery bow that embodies a number of differing aspects or feature: (1) For example, in the embodiment of FIGS. 1–14, bowstring cable BSC is anchored to the draw length adjustment module rather than to the cam base itself, which maintains bow operating characteristics and stored energy as bow length is adjusted without requiring adjustment at the control wheel. (2) In accordance with another aspect of the invention illustrated in FIG. 25, the cam or control wheel is secured to an axle, which in turn is rotatably carried by the associated bow limb. This improves stability and reduces tilt of the cam or wheel. It is to be noted that this aspect of the invention is usable in both single-cam and dual-cam bows. (3) The power cable groove sidewalls on the draw length adjustment module are eliminated immediately adjacent to the axis of power cam rotation, which eliminates rubbing of limit of bowstring draw. (4) Provision of concentric cable grooves in the control wheel of a single-cam bow, as illustrated in FIGS. 22–24, provides improved control of limb travel under certain circumstances. (5) Provision of control arm 64 as an integral assembly with draw length adjustment module 62 in the embodiment of FIGS. 1–14 provides for improved adjustment of bow draw length while eliminating the need and expense of separate parts. (6) Provision of indexing adjustment marks 80 (FIGS. 7 and 9) on cam base 60 cooperates with a peripheral edge of draw length adjustment module 62 for making draw length adjustment and tuning of the bow easier. It will also be noted that this aspect or feature of the invention may be implemented in dual-cam bows as well as single-cam bows.

The several aspects or features of the invention may be used separately from each other, or in combination with each other to achieve improved bow adjustment and operating capabilities. The invention has been disclosed in conjunction with presently preferred embodiments thereof, and a number of alternatives and modifications have been suggested. Other alternatives and modifications will readily suggest themselves to persons of ordinary skill in the art. The invention is intended to embrace all such modifications as fall within the spirit and broad scope of the appended claims.

What is claimed is:

1. A single cam compound archery bow that comprises:

a bow handle having projecting limbs, a control wheel rotatably mounted at an end of one of said limbs, a power cam rotatably mounted at an end of the other of said limbs, said power cam including a power cable groove, and bow cable means including a power cable segment anchored at one end to said one limb and at a second end to said power cam at a position to wrap into and unwrap from said power cable groove, a bowstring cable segment and a control cable segment each anchored at said power cam and extending to said control wheel, wherein said power cam comprises a cam base and a draw length module mounted on said cam base for adjusting length of said power cable groove and thereby adjusting draw length of said bow, and wherein said bowstring cable segment is anchored at said power cam to said draw length module so that adjustment of said module on said cam base automatically simultaneously adjusts length of said bowstring cable segment.

2. The bow set forth in claim 1 wherein said module is adjustably positionable on said cam base for adjusting draw length of said bow.

3. The bow set forth in claim 1 wherein said module is adjustably replaceable on said cam base for adjusting draw length of said bow.

4. The bow set forth in claim 1 wherein said module is both adjustably positionable and adjustably replaceable on said cam base for adjusting draw length of said bow.

5. The bow set forth in claim 1 wherein said module is adjustably positionable on said cam base for adjusting draw length of said bow, and wherein said cam base includes an array of indicia on said cam base for selective incremental registry with a perimeter portion of said module at plural incremental positions of said module on said cam base, and means for selectively securing said module to said cam base at each of said incremental positions.

6. The bow set forth in claim 5 comprising a plurality of said modules adjustably replaceable on said cam base for adjusting draw length of said bow, and wherein said modules are constructed such that said array of indicia on said cam base selectively incrementally registers with a perimeter portion of each said module at plural incremental positions of each said module on said cam base.

7. The bow set forth in claim 1 wherein said power cam is mounted for rotation about an axis, and wherein said power cable groove on said module has a first portion spaced from said axis with lateral groove sidewalls that confine said power cable segment as it wraps into and unwraps from said power cable groove and a second portion adjacent to said axis without said sidewalls.

8. The bow set forth in claim 1 further comprising an axle rotatably mounting said power cam to said end of said other limb, wherein said axle is affixed to said power cam and said other bow limb includes bearing means rotatably mounting said axle to said other limb.

9. The bow set forth in claim 1 wherein said control wheel has an axis of rotation on said one limb, and wherein said control wheel has a control groove for receiving said control cable segment and a bowstring let-out groove for receiving said bowstring cable segment, both of said grooves on said control wheel being circular, concentric with said axis and of differing radii from said axis.

10. The bow set forth in claim 1 wherein said control wheel has an axis of rotation on said one limb and a single peripheral groove that is circular and concentric with said axis, said bowstring cable segment and said control cable segment forming a continuous cable that extends around said single groove.

11. The bow set forth in claim 1 further comprising a control arm on said power cam having a control cable groove for wrapping and unwrapping of said control cable segment, said control arm being of integrally formed unitary construction with said module.

12. A single cam compound archery bow that comprises:

a bow handle having projecting limbs, a control wheel rotatably mounted at an end of one of said limbs, a power cam rotatably mounted at an end of the other of said limbs, said power cam including a power cable groove, bow cable means including a power cable segment anchored to said one limb and extending to said power cam, a bowstring cable segment and a control cable segment each anchored at said power cam and extending to said control wheel, and an axle rotatably mounting said power cam to said end of said other limb, wherein said axle is affixed to said power cam and said other bow limb includes bearing means rotatably mounting said axle to said other limb.

13. A compound archery bow that comprises:

a bow handle having projecting limbs, first and second pulley means mounted for rotation at opposed ends of said limbs, and bow cable means extending between and trained around said pulley means for drawing said bow, wherein at least one of said pulley means includes an axle affixed to said pulley means, and wherein at least one of said limbs includes bearing means rotatably mounting said axle to said at least one limb.

14. A single cam compound archery bow that comprises:

a bow handle having projecting limbs, a control wheel rotatably mounted at an end of one of said limbs, said control wheel having a control groove and a first bowstring let-out groove, a power cam rotatably mounted at an end of the other of said limbs, said power cam including a second bowstring let-out groove and a power cable groove, and bow cable means including a power cable segment anchored at one end to said one limb and at a second end to said power cam at a position to wrap into and unwrap from said power cable groove, a bowstring cable segment anchored at said control wheel and said power cam at positions to wrap into and unwrap from said first and second bowstring let-out grooves, and a control cable segment anchored at said control wheel at a position to wrap into and unwrap from said control groove and anchored at said power cam, wherein said control wheel has an axis of rotation on said one limb, and wherein said control groove and said first bowstring let-out groove on said control wheel are circular, concentric with each other and with said axis, and at differing radii from said axis.

15. The bow set forth in claim 14 wherein said power cam comprises a cam base and a draw length module mounted on said cam base for adjusting length of said power cable groove and thereby adjusting draw length of said bow, and wherein said bowstring cable segment is anchored at said power cam to said draw length module so that adjustment of said module on said cam base automatically simultaneously adjusts length of said bowstring cable segment.

16. The bow set forth in claim 14 wherein said power cam is mounted for rotation about an axis, and wherein said power cable groove on said module has a first portion spaced from said axis with lateral groove sidewalls that confine said power cable segment as it wraps into and unwraps from said power cable groove and a second portion adjacent to said axis without said sidewalls.

17. A single cam compound archery bow that comprises:

a bow handle having projecting limbs, a control wheel rotatably mounted at an end of one of said limbs, a power cam rotatably mounted at an end of the other of said limbs, said power cam including a power cable groove, and bow cable means including a power cable segment anchored at one end to said one limb and at a second end to said power cam at a position to wrap into and unwrap from said power cable groove, a bowstring cable segment and a control cable segment each anchored at said power cam and extending to said control wheel, wherein said power cam is mounted for rotation about an axis, and wherein said power cable groove on said power cam has a first portion spaced from said axis with lateral groove sidewalls that confine said power cable segment as it wraps into and unwraps from said power cable groove and a second portion adjacent to said axis without said sidewalls.

18. The bow set forth in claim 17 further comprising a module adjustably positionable on said cam base for adjusting draw length of said bow.

19. The bow set forth in claim 17 further comprising a module adjustably replaceable on said cam base for adjusting draw length of said bow.

20. The bow set forth in claim 17 further comprising a module that is both adjustably positionable and adjustably replaceable on said cam base for adjusting draw length of said bow.

21. The bow set forth in claim 17 further comprising a module that is adjustably positionable on said cam base for adjusting draw length of said bow, and wherein said cam base includes an array of indicia on said cam base for selective incremental registry with a perimeter portion of said module at plural incremental positions of said module on said cam base, and means for selectively securing said module to said cam base at each of said incremental positions.

22. The bow set forth in claim 21 comprising a plurality of said modules adjustably replaceable on said cam base for adjusting draw length of said bow, and wherein said modules are constructed such that said array of indicia on said cam base selectively incrementally registers with a perimeter portion of each said module at plural incremental positions of each said module on said cam base.

23. The bow set forth in claim 17 further comprising an axle rotatably mounting said power cam to said end of said other limb, wherein said axle is affixed to said power cam and said other bow limb includes bearing means rotatably mounting said axle to said other limb.

24. The bow set forth in claim 17 wherein said control wheel has an axis of rotation on said one limb, and wherein said control wheel has a control groove for receiving said control cable segment and a bowstring let-out groove for receiving said bowstring cable segment, both of said grooves on said control wheel being circular, concentric with said axis and of differing radii from said axis.

25. The bow set forth in claim 17 wherein said control wheel has an axis of rotation on said one limb and a single peripheral groove that is circular and concentric with said axis, said bowstring cable segment and said control cable segment forming a continuous cable that extends around said single groove.

26. The bow set forth in claim 17 further comprising a control arm on said power cam having a control cable groove for wrapping and unwrapping of said control cable segment, said control arm being of integrally formed unitary construction with said module.

27. A single cam compound archery bow that comprises:

a bow handle having projecting limbs, a control wheel rotatably mounted at an end of one of said limbs, a power cam rotatably mounted at an end of the other of said limbs, said power cam including a power cable groove, bow cable means including a power cable segment anchored at one end to said one limb and at a second end to said power cam at a position to wrap into and unwrap from said power cable groove, a bowstring cable segment and a control cable segment each anchored at said power cam and extending to said control wheel, said power cam comprising a cam base and a draw length module mounted on said cam base for adjusting length of said power cable groove and thereby adjusting draw length of said bow, and a control arm on said power cam having a control cable groove for wrapping and unwrapping of said control cable segment, said control arm being of integrally formed unitary construction with said module.

28. The bow set forth in claim 27 wherein said module is adjustably positionable on said cam base for adjusting draw length of said bow.

29. The bow set forth in claim 27 wherein said module is adjustably replaceable on said cam base for adjusting draw length of said bow.

30. The bow set forth in claim 27 wherein said module is both adjustably positionable and adjustably replaceable on said cam base for adjusting draw length of said bow.

31. The bow set forth in claim 27 wherein said module is adjustably positionable on said cam base for adjusting draw length of said bow, and wherein said cam base includes an array of indicia on said cam base for selective incremental registry with a perimeter portion of said module at plural incremental positions of said module on said cam base, and means for selectively securing said module to said cam base at each of said incremental positions.

32. The bow set forth in claim 31 comprising a plurality of said modules adjustably replaceable on said cam base for adjusting draw length of said bow, and wherein said modules are constructed such that said array of indicia on said cam base selectively incrementally registers with a perimeter portion of each said module at plural incremental positions of each said module on said cam base.

33. The bow set forth in claim 27 wherein said power cam is mounted for rotation about an axis, and wherein said power cable groove on said module has a first portion spaced from said axis with lateral groove sidewalls that confine said power cable segment as it wraps into and unwraps from said power cable groove and a second portion adjacent to said axis without said sidewalls.

34. The bow set forth in claim 27 further comprising an axle rotatably mounting said power cam to said end of said other limb, wherein said axle is affixed to said power cam and said other bow limb includes bearing means rotatably mounting said axle to said other limb.

35. The bow set forth in claim 27 wherein said control wheel has an axis of rotation on said one limb, and wherein said control wheel has a control groove for receiving said control cable segment and a bowstring let-out groove for receiving said bowstring cable segment, both of said grooves on said control wheel being circular, concentric with said axis and of differing radii from said axis.

36. The bow set forth in claim 27 wherein said control wheel has an axis of rotation on said one limb and a single peripheral groove that is circular and concentric with said axis, said bowstring cable segment and said control cable segment forming a continuous cable that extends around said single groove.

37. The bow set forth in claim 27 further comprising a control arm on said power cam having a control cable groove for wrapping and unwrapping of said control cable segment, said control arm being of unitary construction with said module.

38. A single cam compound archery bow that comprises:

a bow handle having projecting limbs, a control wheel rotatably mounted at an end of one of said limbs, a power cam rotatably mounted at an end of the other of said limbs, said power cam including a power cable groove, and bow cable means including a power cable segment anchored at one end to said one limb and at a second end to said power cam at a position to wrap into and unwrap from said power cable groove, a bowstring cable segment and a control cable segment each anchored at said power cam and extending to said control wheel, wherein said power cam comprises a cam base and a draw length module mounted on said cam base for adjusting length of said power cable groove and thereby adjusting draw length of said bow, and wherein said module is adjustably positionable on said cam base for adjusting draw length of said bow, and wherein said cam base includes an array of indicia on said cam base for selective incremental registry with a perimeter portion of said module at plural incremental positions of said module on said cam base, and means for selectively securing said module to said cam base at each of said incremental positions.

39. The bow set forth in claim 38 comprising a plurality of said modules adjustably replaceable on said cam base for adjusting draw length of said bow, and wherein said modules are constructed such that said array of indicia on said cam base selectively incrementally registers with a perimeter portion of each said module at plural incremental positions of each said module on said cam base.

40. The bow set forth in claim 38 wherein said power cam is mounted for rotation about an axis, and wherein said power cable groove on said module has a first portion spaced from said axis with lateral groove sidewalls that confine said power cable segment as it wraps into and unwraps from said power cable groove and a second portion adjacent to said axis without said sidewalls.

41. The bow set forth in claim 38 further comprising an axle rotatably mounting said power cam to said end of said other limb, wherein said axle is affixed to said power cam and said other bow limb includes bearing means rotatably mounting said axle to said other limb.

42. The bow set forth in claim 38 further comprising a control arm on said power cam having a control cable groove for wrapping and unwrapping of said control cable segment, said control arm being of integrally formed unitary construction with said module.

43. The bow set forth in claim 38 wherein said control wheel and said cam base each include an array of timing marks associated with said array of indicia for alignment with segments of said bow cable means to adjust timing of rotation of said control wheel and said power cam relative to each other upon adjustment of said module.

44. A power cam for a single-cam compound archery bow having power, bowstring and control cable segments, said power cam comprising:

a cam base having a bowstring let-out groove for wrapping and unwrapping of the bowstring cable segment and an anchor for the power cable segment, and a draw length module mounted on said cam base, said draw length module including a power cable groove for wrapping and unwrapping of the power cable segment, a control cable groove for wrapping and unwrapping of the control cable segment, and an anchor for the bowstring cable segment.

45. The cam set forth in claim 44 wherein said module is adjustably positionable on said cam base for adjusting draw length of the bow, and wherein said cam base includes an array of indicia on said cam base for selective incremental registry with a perimeter portion of said module at plural incremental positions of said module on said cam base, and means for selectively securing said module to said cam base at each of said incremental positions.

46. The cam set forth in claim 45 comprising a plurality of said modules adjustably replaceable on said cam base for adjusting draw length of the bow, and wherein said modules are constructed such that array of indicia on said cam base selectively incrementally registers with a perimeter portion of each said module at plural incremental positions of each said module on said cam base.

47. The cam set forth in claim 44 including means for mounting said cam about an axis of rotation, and wherein said power cable groove on said module has a first portion spaced from said axis with lateral groove sidewalls that confine the power cable segment as it wraps into and unwraps from said power cable groove and a second portion adjacent to said axis without said sidewalls.

48. The cam set forth in claim 44 wherein said module includes a control arm of integrally formed unitary construction with said module and having said control cable groove.

49. A compound archery bow that comprises:

a bow handle having projecting limbs, first and second pulleys mounted for rotation at opposed ends of said limbs, and bow cable means extending between and trained around said pulleys for drawing said bow, wherein at least one of said pulleys includes a base, a plurality of modules adjustably positionable and replaceable on said base for adjusting draw length of said bow, an array of indicia on said base for selective incremental registry with a perimeter portion of said module at plural incremental positions of said module on said base, and means for selectively securing each of said modules to said base at each of said incremental positions, said modules being constructed such that said array of indicia on said cam base selectively incrementally registers with a perimeter portion of each said module at plural incremental positions of each said module on said base.

50. A cam for a compound archery bow that comprises: a base for rotatable mounting on a bow limb, a plurality of modules adjustably positionable and replaceable on said base for adjusting draw length of the bow, an array of indicia on said base for selective incremental registry with a perimeter portion of said module at plural incremental positions of said module on said base, and means for selectively securing each said module to said base at each of said incremental positions, said modules being constructed such that said array of indicia on said cam base selectively incrementally registers with a perimeter portion of each said module at plural incremental positions of each said module on said base.

* * * * *